United States Patent [19]

Buchschmid et al.

[11] Patent Number: 4,740,773

[45] Date of Patent: Apr. 26, 1988

[54] IGNITION DEVICE WITH A HIGH-VOLTAGE TERMINAL

[75] Inventors: Emil Buchschmid, Rosstal; Manfred Hüttinger, Oberasbach; Hans-Dieter Schmid, Nürnberg; Horst-Günter Steffen, Schwarzenbruck, all of Fed. Rep. of Germany

[73] Assignee: Robert Bosch GmbH, Stuttgart, Fed. Rep. of Germany

[21] Appl. No.: 931,687

[22] PCT Filed: Oct. 5, 1985

[86] PCT No.: PCT/DE85/00367

§ 371 Date: Oct. 10, 1986

§ 102(e) Date: Oct. 10, 1986

[87] PCT Pub. No.: WO86/05315

PCT Pub. Date: Sep. 12, 1986

[30] Foreign Application Priority Data

Feb. 27, 1985 [DE] Fed. Rep. of Germany ..... 3506929

[51] Int. Cl.[4] ..... H01F 15/10; H01F 27/04

[52] U.S. Cl. ..... 336/96; 336/107; 336/192; 439/863

[58] Field of Search ..... 336/192, 205, 105, 107, 336/96; 310/71; 439/863, 792

[56] References Cited

U.S. PATENT DOCUMENTS

| | | | |
|---|---|---|---|
| 2,447,376 | 8/1948 | Tognola | 336/107 |
| 2,511,693 | 6/1950 | Burghoff | 336/107 |
| 2,571,769 | 10/1951 | Segall | 336/107 X |
| 3,175,176 | 3/1965 | Henschke | 336/96 X |
| 3,909,759 | 9/1975 | Ouellette et al. | 336/107 |
| 4,232,284 | 11/1980 | Phelon et al. | 336/192 X |
| 4,408,176 | 10/1983 | Nakamura | 336/96 X |
| 4,509,033 | 4/1985 | Weiss et al. | 336/96 X |
| 4,580,122 | 4/1986 | Wörz | 336/205 |
| 4,596,973 | 6/1986 | Form et al. | 336/96 |

FOREIGN PATENT DOCUMENTS 2720446 11/1977 Fed. Rep. of Germany .

*Primary Examiner*—Thomas J. Kozma
*Attorney, Agent, or Firm*—Michael J. Striker

[57] ABSTRACT

An ignition device has a housing provided with a high voltage terminal post for receiving a cable. An ignition winding is supported in a coil form. An end of a solid wire is inserted into a hole in the coil form and an end of the ignition winding is wound around a free part of the wire. Then the coil form is inserted into the housing and the free end part of the wire is received in a housing recess at the rear end of the terminal post. A contact pin is pressed into the terminal post unitl the rear end of the pin makes contact with the wire. Then the housing recess is filled with casting resin to fix the pin and the wire with the winding end in position.

7 Claims, 1 Drawing Sheet

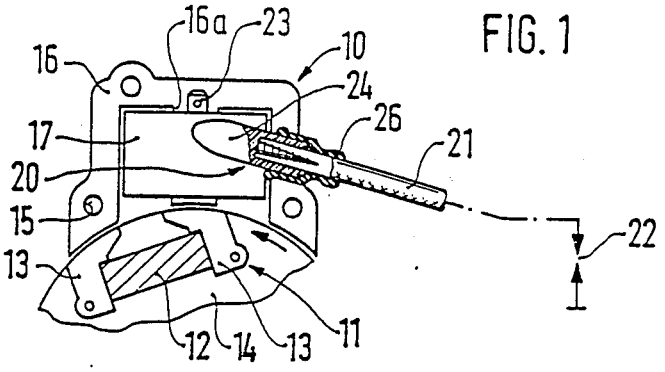
FIG. 1
FIG. 3
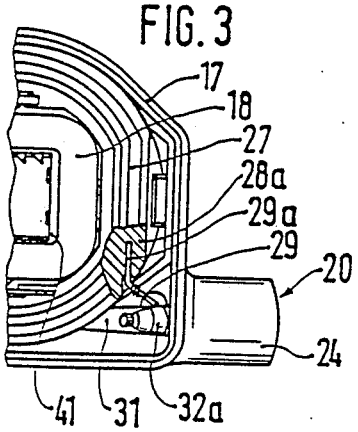
FIG. 2
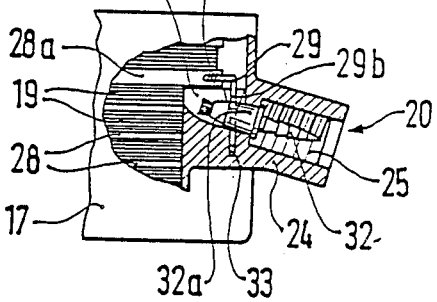
FIG. 5
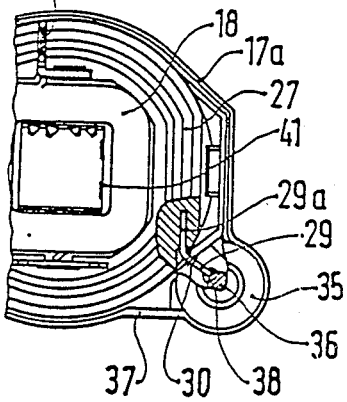
FIG. 4
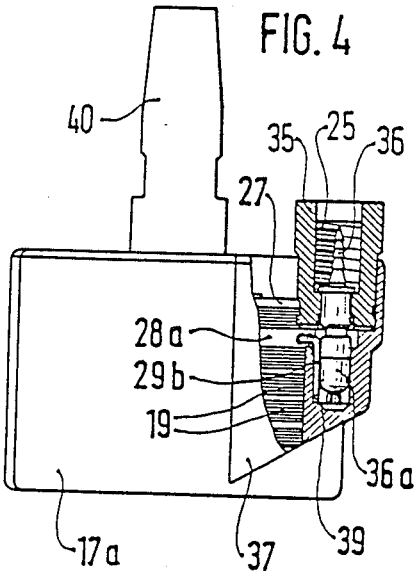

IGNITION DEVICE WITH A HIGH-VOLTAGE TERMINAL

PRIOR ART

The invention is based on an ignition device with a high-voltage terminal including a tubular post for receiving an ignition cable and a contact pin having its rear end enclosed at a base of the opening of the tubular post, and a coil form arranged in a housing and carrying an ignition winding. In a known high-voltage terminal of an ignition device (DE-OS No. 32 05 714) the winding end of the secondary winding of an ignition armature is twisted repeatedly and then guided through a borehole in the terminal post of an ignition cable. A contact pin is pressed into the borehole by its rear end and in so doing makes contact with the winding end in the circumferential area. The twisted winding end projecting from the borehole is then removed and the housing container with the primary and secondary windings of the ignition armature is potted with casting resin. The end of the ignition cable can now be placed on the contact pin which is arranged in the borehole of the terminal post.

Such solutions are involved and time consuming to produce insofar as the twisted winding end of the high-voltage winding must be introduced in the terminal post by hand. With the present solution it is endeavored to form the high-voltage terminal in such a way that the very thin wire end of the high-voltage winding is electrically connected with the contact pin in the terminal post by means of working steps which are to be carried out mechanically.

ADVANTAGES OF THE INVENTION

The high-voltage terminal of the ignition device with the characterizing features of the main claim, according to the invention, in contrast to the known solution, has the advantage that the thin wire end of the high-voltage winding need no longer be fastened at the coil form for protection against an unintentional unwinding, but, rather, it can immediately be mechanically wound around the solid wire inserted in the coil form so as to make electrical contact with it. Another advantage consists in that a reliable contact of the solid wire with the contact pin is effected at the same time as the contact pin is pressed into the borehole of the terminal post. A twisting of the winding end is no longer necessary, since in this solution there is no longer the risk that the very thin winding wire will be squeezed off when the contact pin is pressed in.

Advantageous developments and improvements of the features indicated in the main claim are possible by means of the measures mentioned in the subclaims. It is particularly advantageous that the end area of the solid wire received in the housing recess be bent at a right angle to the end fastened in the coil form. By means of this measure it is ensured that the solid wire is received at the correct place in the housing recess during the mechanical insertion of the coil form with the primary and secondary windings in the housing. In an advantageous manner the housing recess is molded into a housing container receiving the primary and secondary windings.

DRAWING

Two embodiment examples of the invention are shown in the drawing and explained in more detail in the following description.

FIG. 1 shows a magneto ignition system with an ignition armature in whose high-voltage terminal an ignition cable is inserted, FIG. 2 shows a longitudinal section through the high-voltage terminal in enlarged scale and, FIG. 3 shows a portion of the housing container, with the coil form inserted therein, in a top view, FIG. 4 shows, as second embodiment example, a housing container with a cross section through the high-voltage terminal in enlarged scale and FIG. 5 shows a portion of the housing container with the coil form in a top view.

DESCRIPTION OF THE EMBODIMENT EXAMPLES

The magneto ignition system for an internal-combustion engine, shown in FIG. 1, consists of an ignition armature 10 and a revolving magnet system 11. The magnet system 11 comprises a permanent magnet 12 and two pole shoes 13 arranged to the side of the latter. The permanent magnet 12 and the pole shoe 13 are inserted at the circumference of a disk 14, which is driven by the internal-combustion engine, or in the fan wheel of the engine, respectively, of which only a cut-away section is shown. The ignition armature 10 is screwed on the engine housing or the like at the outer circumference of the disk 14 through fastening holes 15. The ignition armature 10 serves to generate the ignition power. At the same time, it is an ignition transformer for generating a high-voltage pulse at the moment of ignition. For this purpose, a housing container 17 of insulating material is placed on the middle leg **16*a* of the E-shaped iron core 16. In the container 17 winding 18, seen in FIG. 3, and a secondary winding 19, seen in FIG. 2, are arranged concentrically one above the other. The secondary winding 19 is connected by its high-voltage winding end to an ignition cable 21 via a high-voltage terminal 20, the ignition cable 21 leading to a symbolically notated spark plug 22. The primary and secondary windings 18 and 19 are potted with casting resin in the housing container 17 together with the electronic switching elements, not shown. The ignition system can be short-circuited on the primary side via a flat plug tongue 23 by means of a shut-off switch, not shown, in order in this manner to stop the internal-combustion engine. The high-voltage terminal 20 of the secondary winding 19 consists of a terminal post 24 in whose opening 25 the end of the ignition cable 21 is screwed and sealed against moisture by means of a bush 26**.

As shown in FIGS. 2 and 3, the secondary winding 19 is wound as high-voltage winding in winding chambers of a coil form 27 made from insulating material, the winding chambers being arranged axially one above the other, wherein the individual winding portions are separated from one another by means of webs 28. The upper web **28*a* between the last and next to last winding portions of the secondary winding 19 is constructed so as to be somewhat thicker. A piece of solid wire 29 is inserted radially by one end 29*a* in a corresponding borehole. The high-voltage end 30 of the very thin winding wire or the secondary winding is wound repeatedly around the solid wire 29 projecting from the web 28*a* and is soldered with it. The other end area 29b of the solid wire 29 is bent downward at a right angle and received in a housing recess 31 at the terminal post 24 of the housing container 17. An outwardly tapering contact pin 32, which is pressed into the housing recess 31 by its bolt-shaped rear end 32a, is arranged in the opening 25 of the terminal post 20. Here, the housing recess 31 is constructed in the form of a trough which is open at the top and ends in a borehole at the base of the opening 25 of the terminal post 24 in which the bolt-shaped end 32a of the contact pin 32 is inserted. As the contact pin 32 is pressed into the housing recess 31 the bolt-shaped rear end 32a simultaneously makes contact with the lower end portion 29b of the solid wire 29. For this purpose the housing recess 31, which is constructed as a trough, is provided with a laterally adjacent blind hole 33 for receiving the lower end area 29b of the solid wire 29 the hole 33 being widened in a funnel-shaped manner at its top for an improved introduction of the solid wire 29**.

In the production of the ignition armature 10 the primary winding 18 and the secondary winding 19 are wound separately from one another and are then pushed one into the other concentrically and connected with one another. The primary winding 18 is arranged on the inside and the secondary winding 19 with its coil form 27 is arranged on the outside. After the winding of the secondary winding 19, the solid wire 29 is inserted by its end 29a in the web 28a of the coil form 27 and the end 30 of the secondary winding 19 is wound around the free part of the wire repeatedly and makes contact with it. The free end part 29b of the solid wire 29 is then bent downward at a right angle and the constructional unit which is thus prepared beforehand is now inserted in the housing container 17. The end area 29b of the solid wire 29 is received in the blind hole 33 at the housing recess 31. Thereafter, the contact pin 32 is inserted from the outside into the opening 25 of the terminal post 24 which is formed on the outside of the housing container 17, and its bolt-shaped rear end 32a is pressed into the housing recess 31 and makes contact with the end part 29b of the solid wire 29. Finally, the housing container 17 is filled with casting resin in a manner not shown, wherein the housing recess 31 is also filled with casting resin and the contact pin 32 is anchored in the latter in a form locking manner.

FIGS. 4 and 5 show another embodiment example of an ignition armature, in enlarged scale, with the characteristic features of the present invention. In this embodiment example the same reference numbers are used for the same parts of the ignition armature. Instead of the terminal post 24 which is formed on at the outside of the housing container in the first embodiment example, a terminal post 35, with its contact pin 36 as preassembled unit, is inserted in a corresponding formed out portion 37 of the housing container 17a. The bolt-shaped rear end 36a of the contact pin 36 is here pressed into a housing recess 38, constructed as a blind hole, in the area of the formed out portion 37 of the housing container 17 vertically from above. For the reception of the end area 29b of the solid wire 29 the blind hole 38 is provided with a laterally adjacent trough 39 which widens at the top in a funnel-shaped manner for the introduction of the solid wire 29. After the insertion of the primary and secondary windings 18, 19 in the housing container 17a—in a different manner than in the first embodiment example—the terminal post 35 with the contact pin 36, as preassembled unit, is pressed into the housing recess 38, which is constructed as a blind hole, and makes contact with the solid wire 29. The terminal post 35 is then embedded, together with the other structural component parts, in the housing container 17a in casting resin. A contact lug 40, seen in FIG. 4, serves as a ground connection with the iron core 16 of the ignition armature according to FIG. 1, in which this contact lug 40 is bent toward the middle leg 16a of the iron core 16 and is clamped between the latter and a flue 41 of the housing container 17a.

The invention is not limited to the two shown embodiment examples, since the arrangement and form of the solid wire 29 at the coil form 27 of the secondary winding, as well as the arrangement and form of the housing recess 31 and 38, can be changed in accordance with the respective requirements without abandoning the principle of the solution, which consists in the use of a solid wire in order for a high-voltage terminal to make contact with the end of a high-voltage winding, which solid wire is inserted with one end in a coil form carrying the high-voltage winding on the one hand, the end of the high-voltage winding being repeatedly wound about it, and is received with the other end area in a housing recess at the terminal post in which the contact pin is pressed with its bolt-shaped rear end and makes contact with the solid wire. This solution principle is not only to be applied in ignition armatures, but also, in the same way, in ignition coils and other windings which are provided with a high-voltage terminal.

We claim:

1. Ignition device having a housing provided with a high voltage terminal and a coil form mounted in said housing and carrying an ignition winding, the terminal including a terminal post for receiving an ignition cable; a contact pin having a bolt-shaped rear end; and a piece of contact solid wire inserted at one end thereof immediately in said coil form, said housing having a recess at said terminal post, an end portion of said ignition winding being wound around a part of said solid wire to make contact with the same, said solid wire having a free end part received in said housing recess at a base of the terminal post, said bolt-shaped rear end of said contact pin being pressed in said housing recess so as make contact with said free end part of said solid wire.

2. Ignition device according to claim 1, wherein said end part of said solid wire which is received in said housing recess is bent at a right angle from said one end inserted in said coil form, said one end being fastened in said coil form.

3. Ignition device according to claim 1, wherein said housing recess is formed in a housing container of an ignition armature in which are arranged a primary and a secondary ignition winding.

4. Ignition device according to claim 3, wherein said terminal post with said contact pin is pressed into said housing recess as a preassembled unit and is embedded together with said solid wire and said ignition winding in casting resin in said housing container.

5. Ignition device according to claim 1, wherein said terminal post is formed on the outside of said housing container in the area of said housing recess.

6. Ignition device according to claim 1, wherein said housing recess is constructed as a trough for receiving said rear end of said contact pin, said trough having a laterally adjacent blind hole for receiving said free end part of said solid wire.

7. Ignition device according to claim 5, wherein said housing recess is provided with a blind hole for receiving said rear end of said contact pin, said blind hole communicating with a laterally adjacent trough for receiving said free end part of said solid wire.

* * * * *